US005920300A

United States Patent [19]

Yamazaki et al.

[11] Patent Number: 5,920,300

[45] Date of Patent: Jul. 6, 1999

[54] ACTIVE MATRIX LIQUID CRYSTAL DISPLAY DEVICE

[75] Inventors: Shunpei Yamazaki, Tokyo; Jun Koyama, Kanagawa, both of Japan

[73] Assignee: Semiconductor Energy Laboratory Co., Ltd., Japan

[21] Appl. No.: 08/542,795

[22] Filed: Oct. 13, 1995

[30] Foreign Application Priority Data

Oct. 27, 1994 [JP] Japan ..... 6-287256

[51] Int. Cl.[6] ..... G09G 3/36

[52] U.S. Cl. ..... 345/94

[58] Field of Search ..... 345/94, 87, 97, 345/211

[56] References Cited

U.S. PATENT DOCUMENTS 4,830,467 5/1989 Inoue et al. ..... 345/94
4,873,516 10/1989 Castleberry ..... 340/784
5,111,319 5/1992 Morris ..... 359/85
5,233,417 8/1993 Nouso ..... 358/105
5,351,145 9/1994 Miyata et al. ..... 345/87
5,576,737 11/1996 Isozaki et al. ..... 345/211

*Primary Examiner*—Mark K. Zimmerman
*Assistant Examiner*—Ronald Laneau
*Attorney, Agent, or Firm*—Edward D. Manzo; Mark J. Murphy

[57] ABSTRACT

It is intended to increase the display speed in an active matrix liquid crystal display device. In displaying a moving picture, different voltages are applied in two steps to each pixel, i.e., each liquid crystal cell. More specifically, after a high voltage is applied first, and then a low voltage is applied at a prescribed timing, so that the rising characteristic of the liquid crystal is improved. In a specific configuration, thin-film transistors are provided on both sides of a pair of electrodes between which the liquid crystal is interposed. A voltage for accelerating the liquid crystal operation is applied from one of the two thin-film transistors, and the same voltage as in the case of displaying a still picture is applied from the other thin-film transistor.

12 Claims, 7 Drawing Sheets

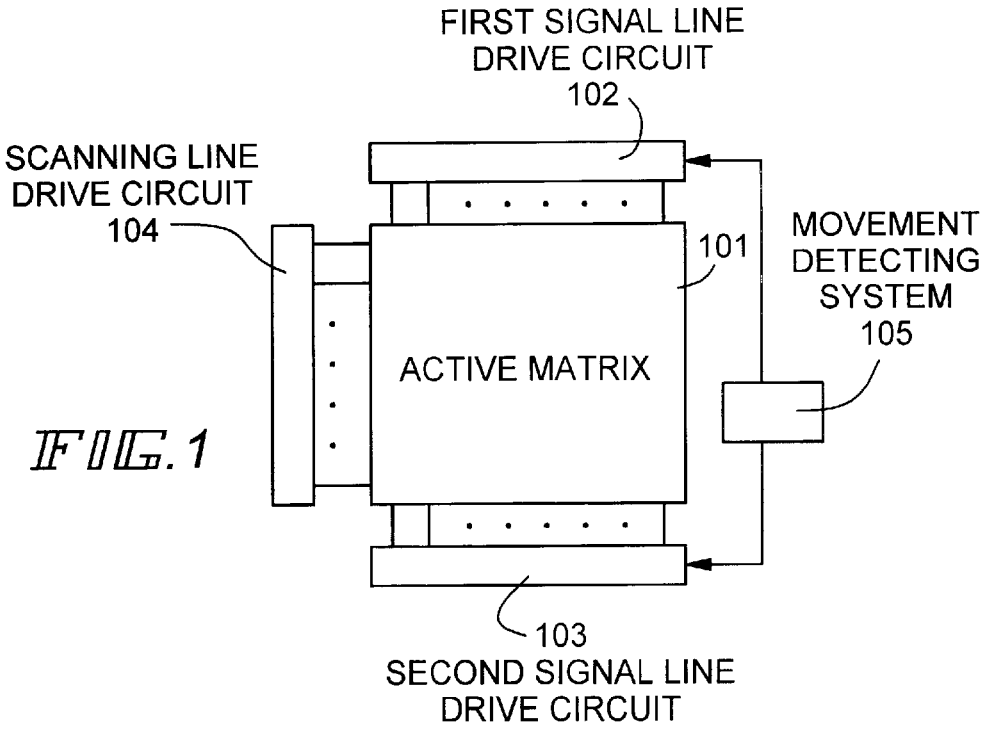
FIG. 1
FIG. 2A
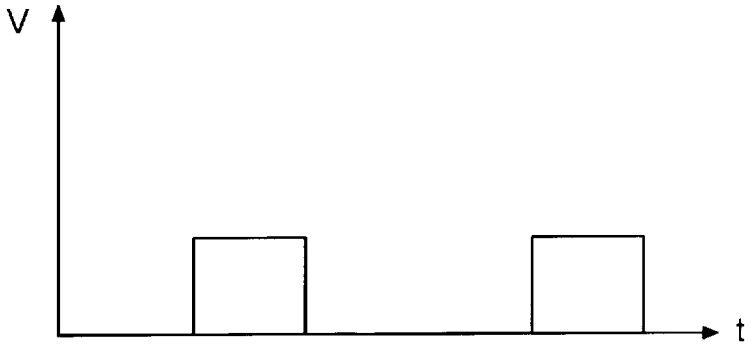
FIG. 2B
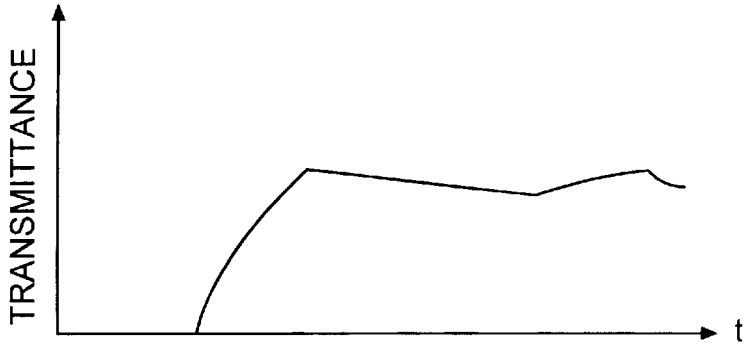

FIG. 3A
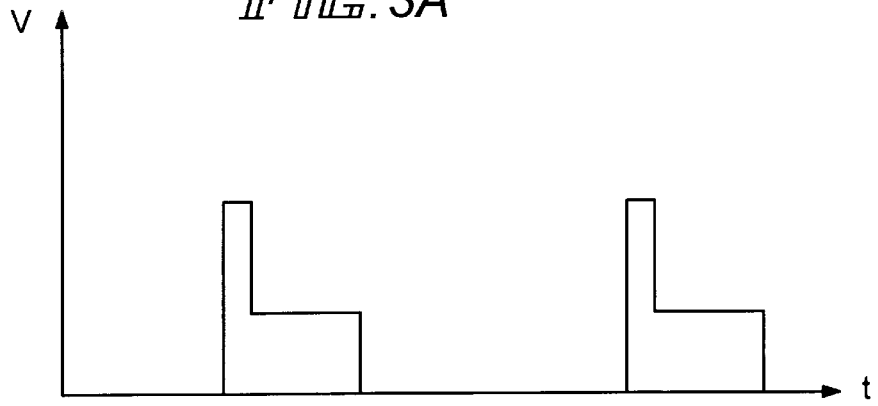
FIG. 3B
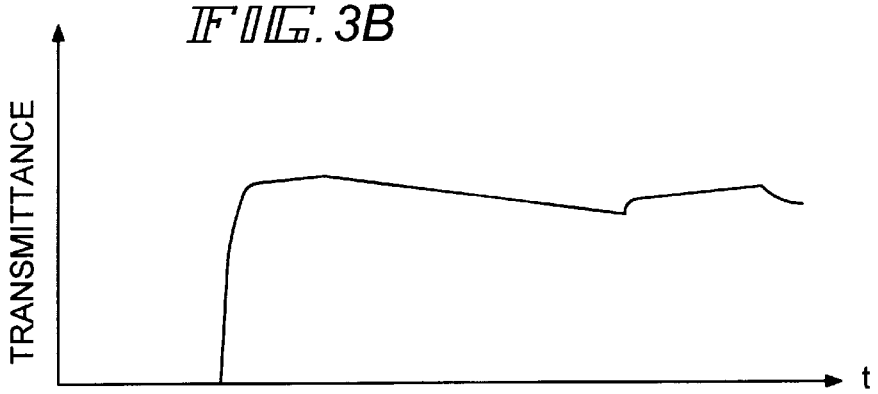
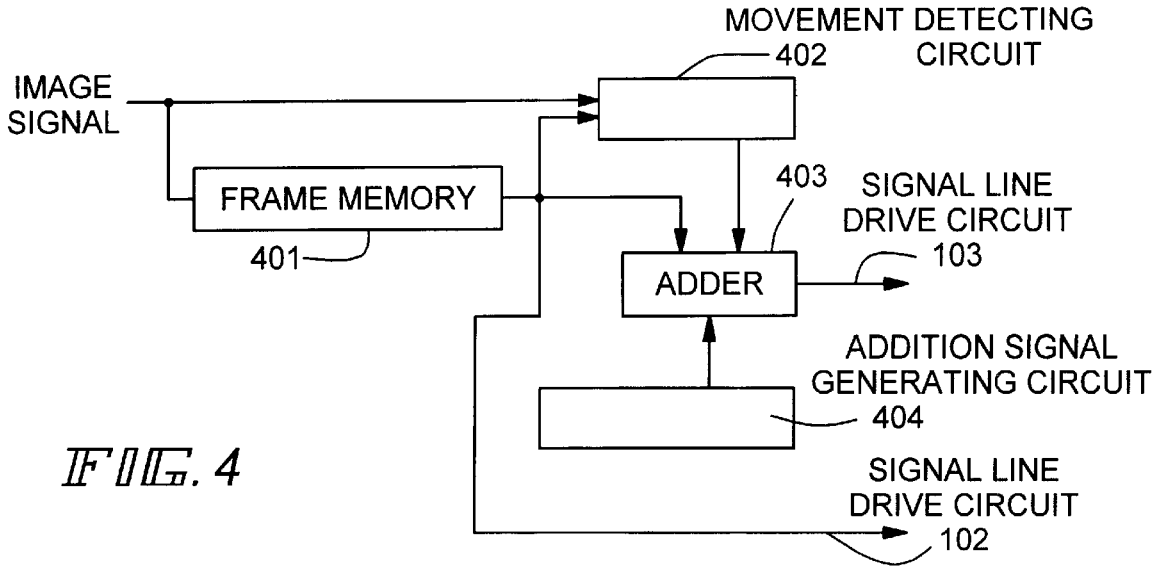
FIG. 4

ACTIVE MATRIX LIQUID CRYSTAL DISPLAY DEVICE

BACKGROUND OF THE INVENTION

1. Field of the Invention

The present invention relates to an active matrix liquid crystal display device, particularly of a type having improved operation speed.

2. Description of the Related Art

Conventionally, CRTs are most commonly used display devices. However, CRTs have the following problems because they use a vacuum glass tube and accelerate electrons by a high voltage:

(1) Large capacity (2) Heavy weight (3) Large power consumption.

In view of the above, flat-panel display devices utilizing plasma or a liquid crystal are now under development.

A liquid crystal display device performs on/off display, i.e., light and shade display by controlling the polarization of light, a transmission light quantity, or a scattering light quantity by using the fact that a liquid crystal material has dielectric constants that are different in the directions parallel with and perpendicular to the molecular axis. Among generally used liquid crystal materials are a TN liquid crystal, a STN liquid crystal, and a ferroelectric liquid crystal.

Particularly in recent years, among various liquid crystal display devices, an active matrix liquid crystal display device has come to be used widely.

FIG. 7 shows an example of a conventional active matrix liquid crystal display device. In this active matrix liquid crystal display, signal lines 701 to 703 and scanning lines 704 to 706 are provided on a glass substrate in a matrix form, and thin-film transistors 707 to 710 are disposed at intersecting points of those lines. THE source electrodes of the thin-film transistors are connected to the signal lines 701 to 703, the gate electrodes are connected to the scanning lines 704 to 706, and the drain electrodes are connected to pixel electrodes (not shown) that are opposed to one of the surfaces of holding capacitors 716 to 719 and pixel region liquid crystals 712 to 715.

FIGS. 8A to 8C show voltages that are applied to the electrodes of a thin-film transistor. As shown in FIG. 8A, an electric signal $V_S$ is applied to the source electrode of the thin-film transistor via signal lines. As shown in FIG. 8B, an electric signal $V_G$ is applied to the gate electrode of the thin-film transistor via scanning lines. In accordance with the signals $V_S$ and $V_G$, a voltage $V_D$ of the drain electrode has a waveform shown in FIG. 8C.

Where the thin-film transistor is of an N-channel type, when the gate voltage becomes high (positive), the thin-film transistor is turned on to equalize the source voltage and the drain voltage. As a result, the voltage of the signal line is written to the holding capacitor. When the gate voltage becomes low (negative), the thin-film transistor is turned off to electrically separate the source and drain electrodes. As a result, the voltage of the holding capacitor is held until the thin-film transistor is turned on next time to cause writing.

The liquid crystal element (indicated by 712 to 715 in FIG. 7) that is interposed between the opposed electrode and the pixel electrode receives a difference of voltages of those electrodes, and its light polarizing characteristic is varied in accordance with the difference voltage. By inserting a polarizing plate, light and shade display is obtained in accordance with the light polarizing state of the liquid crystal element.

Conventional active matrix liquid crystal display devices employ a TN liquid crystal. With a polarizing plate inserted, a TN liquid crystal exhibits a transmittance-applied voltage (V) characteristic as shown in FIG. 10. Having a relatively gentle slope, this transmittance-applied voltage (V) characteristic enables gradational display as controlled by the applied voltage.

However, because TN liquid crystals generally do an effective-value response, they have a problem of slow response to an applied voltage.

In a TN liquid crystal, usually, when the gradation level changes from black to white (see FIG. 11) or vise versa, there occurs a response delay of 10 msec to several tens of milliseconds. That is, the liquid crystal cannot respond until lapse of 10 msec to several tens of milliseconds after the voltage application.

In conventional active matrix liquid crystal display devices, in displaying a certain gradation level, a voltage applied to a liquid crystal display device is considered constant with a lapse of time; that is, the response of a liquid crystal is not taken into consideration.

Therefore, although conventional active matrix liquid crystal display devices can exhibit display performance which is equivalent or superior to that of CRTs in displaying a still picture, they cannot provide image quality equivalent to that of CRTs in displaying a moving picture due to the above-described delayed response.

Conventionally, there are two kinds of methods of producing pixel drive circuits. According to the first method, they are produced as transistor integrated circuits of single crystal silicon. According to the second method, they are produced as thin-film transistors using polysilicon so as to be formed on the same substrate as an active matrix in an integral manner. In the first method, it is a general procedure that the drive circuits are externally provided and connected to an active matrix substrate in the form of TAB or COG. In the second method, the drive circuits are formed on the same substrate as the active matrix and connected thereto by metal wiring. FIG. 9 shows an example of a liquid crystal display device that incorporates drive circuits constituted of polysilicon thin-film transistors.

Therefore, the second method is advantageous over the first method in the following points:

(1) The pixel pitch of the active matrix can be made smaller.

Where the active matrix is driven by use of TAB, the pitch of the active matrix cannot be made smaller than a certain value because the TAB pitch cannot be made smaller than a value that allows bonding to the glass substrate. In the second method, in which the drive circuits are incorporated in the substrate and therefore there exists no bonding to the active matrix, the matrix pitch can be reduced without any TAB-related limitation.

(2) The reliability of the wiring connection can be improved.

In the case of using TAB, several thousands wires come out from the active matrix. Therefore, wire breaking occurs at a high probability at connection points between TAB and the active matrix substrate. On the other hand, where the drive circuits are incorporated in the active matrix substrate, the number of terminals of the substrate for external connection is about 1/100 of the number in the case of using TAB. Thus, an improvement in the reliability is expected.

(3) The size of the display device can be reduced.

Where TAB is employed in a display device, such as a view finder, having a small screen, TAB of the drive circuits is larger than the active matrix, resulting in a limitation in reducing the capacity of a video camera and the like. On the other hand, where the drive circuits are incorporated in the substrate, the circuit width can be made smaller than 5 mm, contributing to the size reduction of such display devices as a view finder.

SUMMARY OF THE INVENTION

In an active matrix liquid crystal display device according to the present invention, to utilize the above advantages, it is preferred that drive circuits be constituted of polysilicon thin-film transistors.

In conventional active matrix liquid crystal display devices, in displaying a certain gradation level, a voltage applied to a liquid crystal is constant with a lapse of time; that is, a response delay of the liquid crystal is not taken into consideration.

In Japanese Unexamined Patent Publication No. Hei. 6-67154, the present inventors disclosed that immediate response of a liquid crystal can be attained by applying to it instantaneously a voltage higher than a voltage corresponding to an intended gradation level.

The inventors observed variations of the transmittance of a liquid crystal material when a constant voltage is applied to it, and when a high voltage is first applied and then the voltage is reduced. FIGS. 2A and 2B and FIGS. 3A and 3B show observation results of the former and latter cases, respectively. FIGS. 2A and 3A show the applied voltage V, and FIGS. 2B and 3B show the transmittance.

As is apparent from the comparison between FIGS. 2A and 2B and FIGS. 3A and 3B, to attain fast response, the method of applying a high voltage to a liquid crystal and then reducing the voltage is more effective than the method of applying the same voltage constantly. It is noted that the low voltage should be so set that the total effective voltage value is the same as in the case of applying a constant voltage.

To perform the above type of voltage application, according to the present invention, there is provided means for detecting a movement in a video signal, and means for applying, to a pixel, i.e., a liquid crystal cell for which a movement is detected, a voltage different from a voltage that is applied when there exists no movement, by effecting voltage addition in a movement-detected frame and a frame that is at least 1-frame period after that frame.

BRIEF DESCRIPTION OF THE DRAWINGS

FIG. 1 schematically shows an active matrix display device according to an embodiment of the present invention;

FIGS. 2A and 2B show a response of a liquid crystal when constant voltage pulses are applied to it;

FIGS. 3A and 3B show a response of a liquid crystal when two-step voltage pulses are applied to it;

FIG. 4 is a block diagram showing a movement detecting system according to the present invention;

DETAILED DESCRIPTION OF THE PREFERRED EMBODIMENT

Figure 5D:
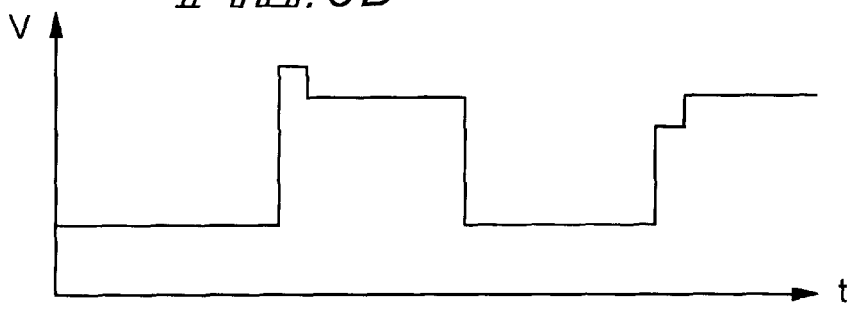
FIGS. 5A to 5D schematically show a voltage application scheme according to the present invention.

FIG. 1 shows an embodiment of the present invention.

Signal line drive circuits 102 and 103 are connected to an active matrix panel 101 via signal lines, and a scanning line drive circuit 104 is connected to the panel 101 via scanning lines. Further, a movement detecting system 105 is provided which controls the signal line drive circuits 102 and 103.

In this embodiment, the movement detecting system 105 detects whether a video signal includes a movement component. If there exists a movement component, the first signal line drive circuit 102 and the second signal line drive circuit 103 applies different voltages to the same pixel.

Figure 6:
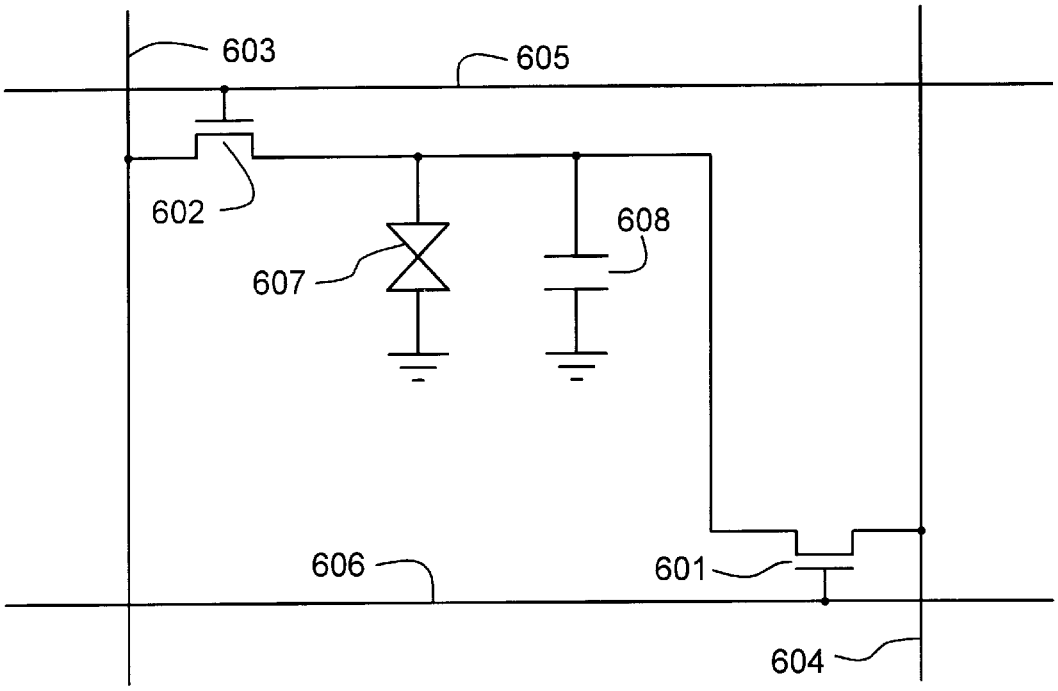
FIG. 6 shows a configuration of a pixel portion according to the present invention.
Figure 7:
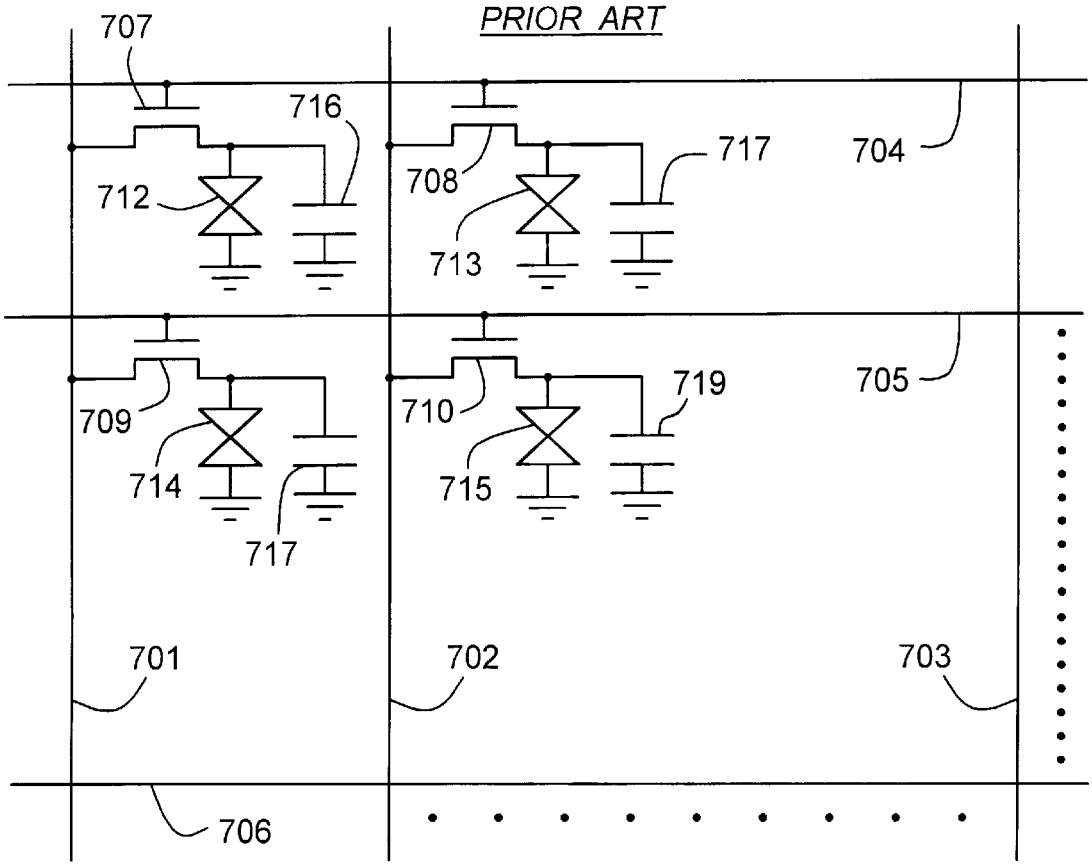
FIG. 7 PRIOR ART
FIG. 7 schematically shows a conventional active matrix.
Figure 8A:
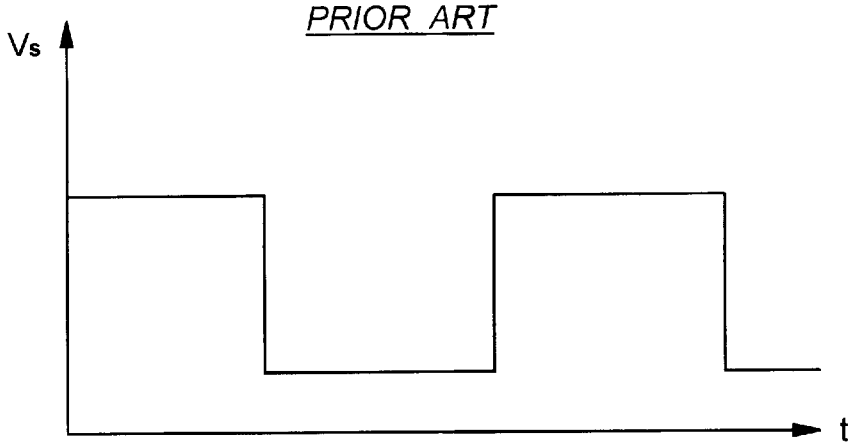
FIG. 8A PRIOR ART
FIGS. 8A to 8C show drive waveforms of the conventional active matrix.
Figure 8B:
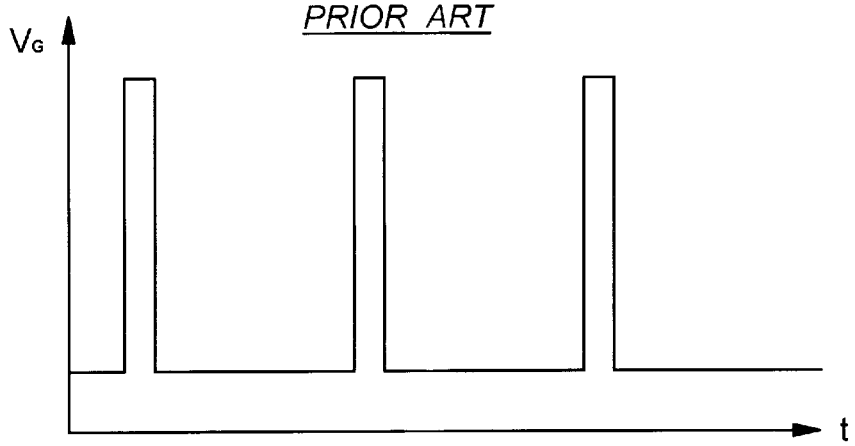
FIG. 8B PRIOR ART
Figure 8C:
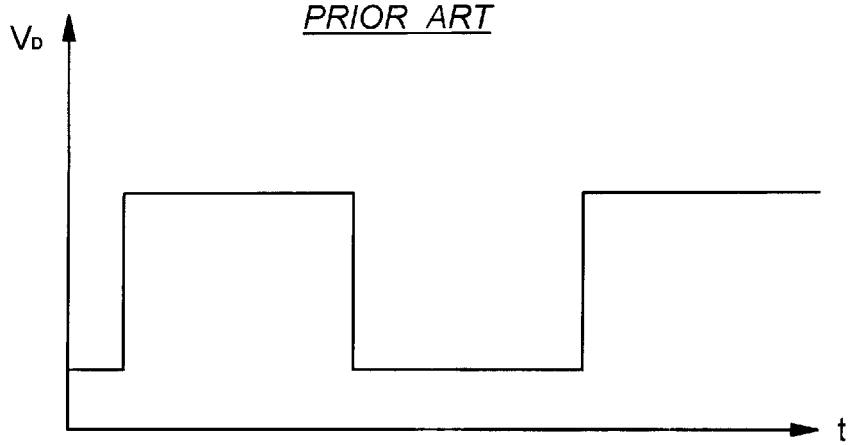
FIG. 8C PRIOR ART
Figure 9:
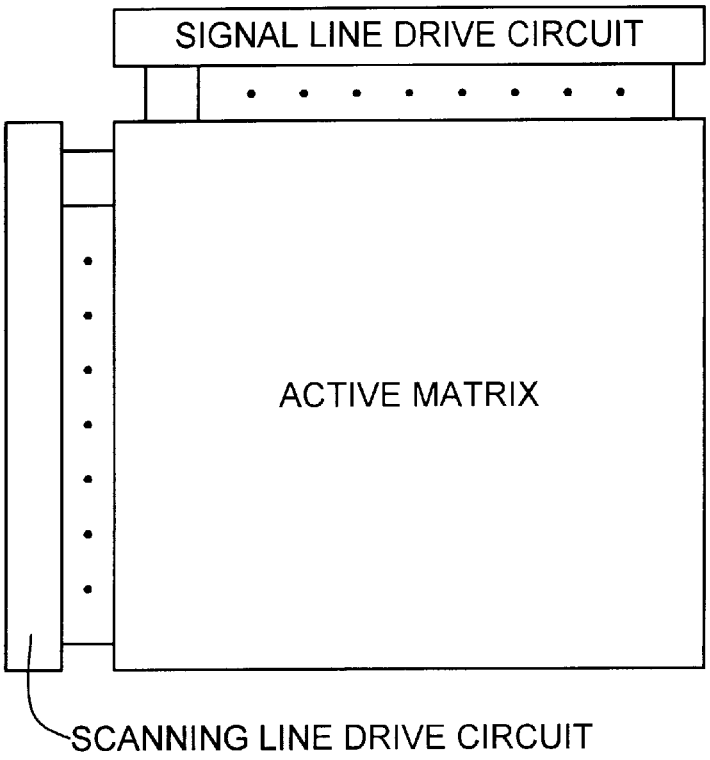
FIG. 9 PRIOR ART
FIG. 9 schematically shows a conventional active matrix display device incorporating drive circuits.
Figure 10:
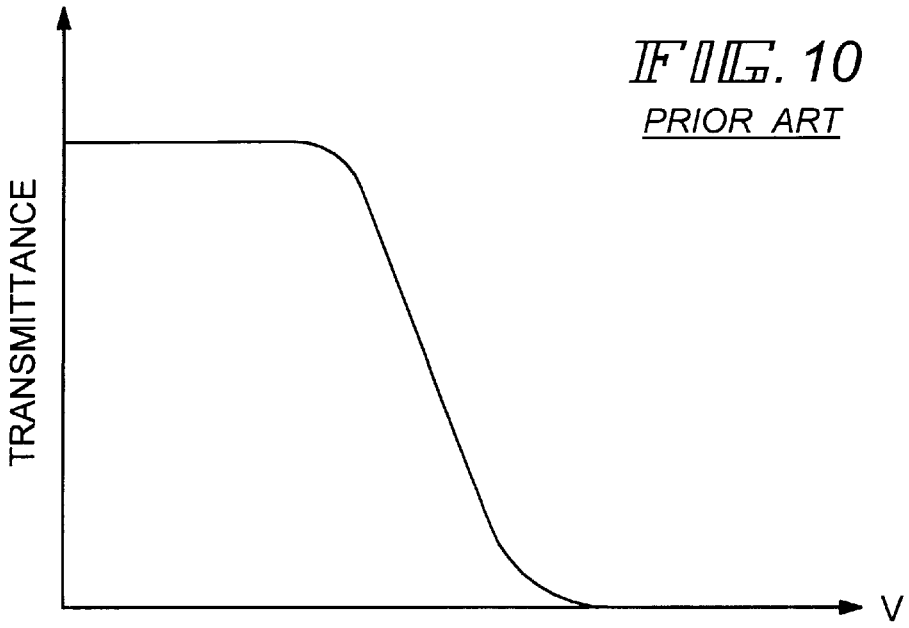
FIG. 10 PRIOR ART
FIG. 10 is a transmittance-applied voltage characteristic of a TN liquid crystal.
Figure 11A:
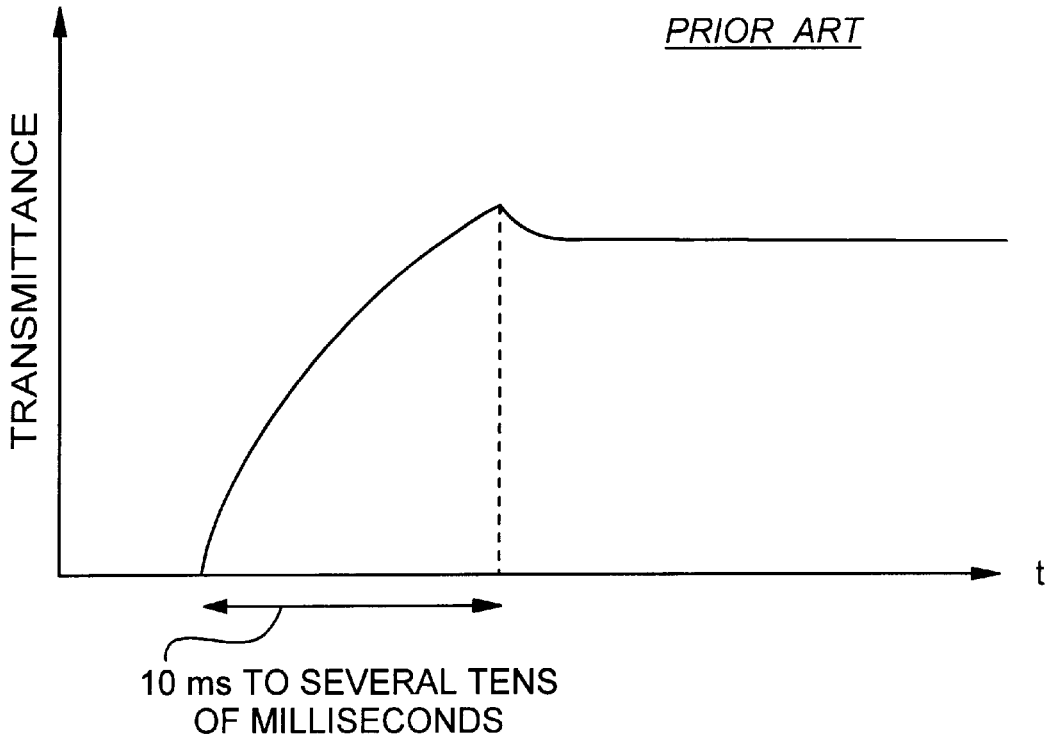
FIG. 11A PRIOR ART
FIG. 11 shows a response characteristic of a TN liquid crystal.
Figure 11B:
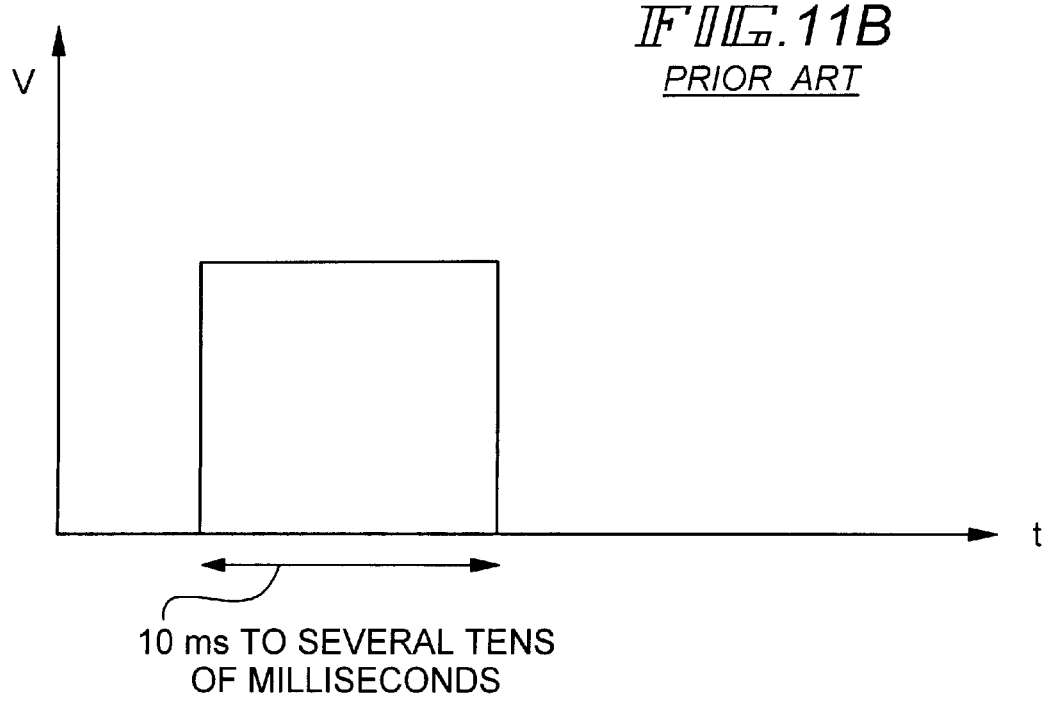
FIG. 11B PRIOR ART

FIG. 6 shows a pixel portion according to the embodiment. In this embodiment, the drain electrodes of two thin-film transistors 601 and 602 are connected to one liquid crystal cell 607. The source electrode of the thin-film transistor 601 is connected to a signal line 604, which is connected to the second signal line drive circuit 103. On the other hand, the source electrode of the thin-film transistor 602 is connected to a signal line 603, which is connected to the first signal line drive circuit 102. The gate electrodes of the thin-film transistors 601 and 602 are adjacent scanning lines 606 and 605. A holding capacitor 608 is connected in parallel to the liquid crystal cell 607.

FIG. 4 schematically shows the movement detecting system 105 according to the embodiment.

An image signal is input to each of a frame memory 401 and a movement detecting circuit 402. An output of the frame memory 401 supplied to each of the movement detecting circuit 402, an adder 403, and the first signal line drive circuit 102. An output of the movement detecting circuit 402 is supplied to the adder 403, and an output of the adder 403 is supplied to the second signal line drive circuit 103.

An input video signal is supplied to the frame memory 401, which stores 1-frame image data. The movement detecting circuit 402 not only receives the image data stored in the frame memory 401 but also directly receives the video signal as image data. The movement detecting circuit 402 generates difference data by subtracting one of the received two image data from the other. Further, the movement detecting circuit 402 removes a noise component from the difference data, and judges whether or not a resulting data represents a movement.

If there exists no component that represents a movement, the adder 403 supplies the image data itself stored in the frame memory 401 to the second signal line drive circuit 103, and the frame memory 401 supplies the image data to the first signal line drive circuit 102 . Therefore, when image data without a movement is displayed, the same video signal is input to the first signal line drive circuit 102 and the second signal line drive circuit 103.

FIGS. 5A to 5D show voltage waveforms in the pixel portion of FIG. 6.

Figure 5C:
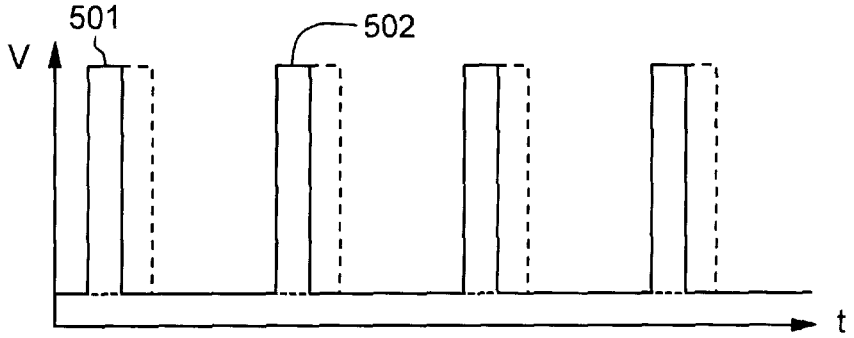
Figure 5B:
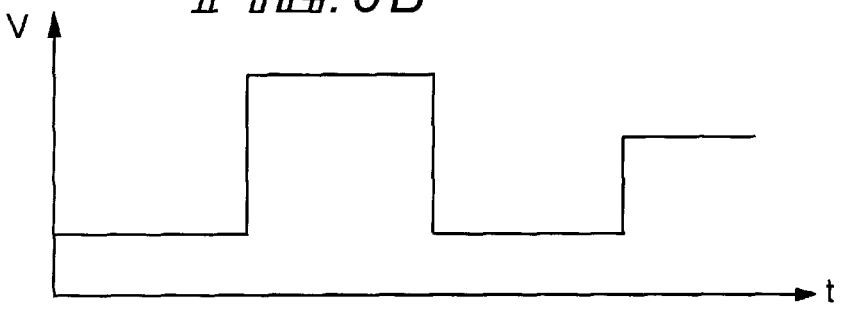
Figure 5A:
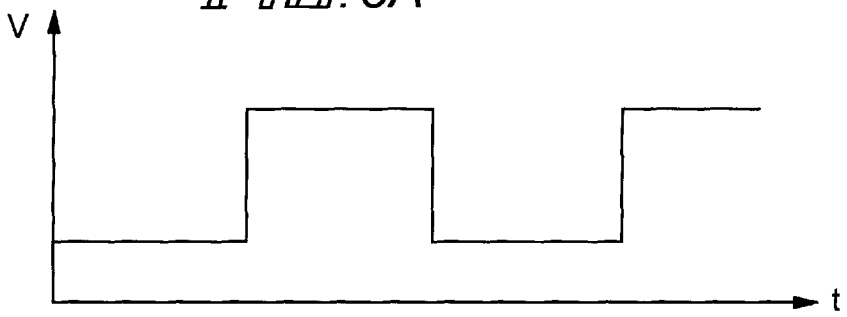

The first and second signal line drive circuits 102 and 103 supply a rectangular signal shown in FIG. 5A to the thin-film transistors 601 and 602 via the signal lines 603 and 604, respectively.

The scanning line drive circuit 104 supplies a signal 501, indicated by a solid line in FIG. 5C, to the gate electrode of the thin-film transistor 601 via the scanning line 605, and a signal 502, indicated by a dotted line in FIG. 5C, to the gate electrode of the thin-film transistor 602. Since the signals 501 and 502 have a 1-line delay, the same image data is written twice to the liquid crystal cell 607 with delay of a 1-line period. This causes no problem to the operation of the liquid crystal.

On the other hand, if the movement detecting circuit 402 judges that the difference data indicates a movement, it supplies a movement detection signal to the adder 403. Upon receiving the movement detection signal, the adder 403 adds a pulse signal that was generated by an addition signal generating circuit 404 to the image data of the frame memory 401, and supplies a resulting signal to the second signal line drive circuit 103. The second signal line drive circuit 103 supplies a signal shown in FIG. 5B to the thin-film transistor 601 via the signal line 604.

As in the case of displaying image data without a movement, the first signal line drive circuit 102 receives the image data itself stored in the frame memory 401, and supplies a signal shown in FIG. 5A to the thin-film transistor 602 via the signal line 603.

The scanning line drive circuit 104 supplies a signal 501 indicated by the solid line in FIG. 5C to the gate electrode of the thin-film transistor 601, and a signal 502 indicated by the dotted line in FIG. 5C to the gate electrode of the thin-film transistor 602. As a result, a voltage shown in FIG. 5D is applied to the liquid crystal cell 607.

Since there is a delay of a 1-line period between the signal 501 that is supplied to the gate electrode of the thin-film transistor 601 and the signal 502 that is supplied to the gate electrode of the thin-film transistor 602, after a high voltage is applied from the second signal line drive circuit 103 for a 1-line period, the same low voltage as in the case of displaying a still picture is applied from the first signal line drive circuit 102. Further, in a frame that is one or more frame periods after the above-described frame, a low voltage that is lower than the low voltage that is applied in displaying a still picture is applied from the second signal line drive circuit 103 and, 1-line period thereafter, the same low voltage as in the case of displaying a still picture is applied from the first signal line drive circuit 102.

Digital signal processing is assumed in the movement detecting system 105 of FIG. 4. An analog video signal can be processed without causing any problem if a video signal is converted to a digital signal by an A/D converter before being input to the frame memory and digital signals are converted to analog signals by D/A converters before being input to the first and second signal line drive circuits 102 and 103.

As described above, according to the present invention, in the case of a video signal having a movement, a 1-line-period voltage that accelerates the liquid crystal operation and the same voltage as in the case of displaying a still picture are applied to a single pixel electrode by means of two thin-film transistors and two signal line drive circuits.

This voltage application scheme enables increase of the operation speed of a liquid crystal display device, thereby providing a user with a display of higher image quality.

What is claimed is:

1. An active matrix liquid crystal display device including a liquid crystal cell disposed at each intersection of the matrix, said device comprising:

first and second thin-film transistors having source or drains thereof being connected to said liquid crystal cell;

a first signal line connected to the source or drain of said first transistor;

a second signal line connected to the source or drain of said second transistor;

a first signal line drive circuit connected to said first signal line;

a second signal line drive circuit connected to said second signal line;

means for detecting whether a pixel has a movement component based on an image signal for said pixel; and means for supplying a first signal into said first signal line and a second signal into said second signal line, in accordance with the output of said detecting means, wherein said movement detecting means comprises:

a frame memory for storing said image signal;

a movement detecting circuit for detecting whether said image signal includes movement components, based upon said image signal and said stored image signal;

a signal generating circuit for generating a pulse signal; and an adder connected to said frame memory, said movement detecting circuit and said signal generating circuit.

2. The active matrix liquid display device of claim 1, wherein said first signal voltage is equivalent to said second signal voltage when said movement detecting means detects no movement.

3. The active matrix liquid display device of claim 1, wherein said first signal voltage is different from said second signal voltage when said movement detecting means detects the movement.

4. The active matrix liquid crystal display device of claim 1, wherein said adder adds said pulse signal to said stored signal, supplying the resulting signal to said first signal drive circuit and said stored signal is supplied from said frame memory into said second signal drive circuit, when said movement detecting means detects the movement.

5. The active matrix liquid crystal display device of claim 1, wherein said adder supplys said stored signal into said first signal drive circuit and said stored signal is supplied from said flame memory into said second signal drive circuit, when said movement detecting means detects no movement.

6. An active matrix liquid crystal display device of claim 1 further comprising of:

a first scanning line for applying a first scanning signal into a gate of said first transistor;

a second scanning line for applying a second scanning signal to a gate of said second transistor;

wherein there is a delay of one line period between said first scanning signal and second scanning signal.

7. An active matrix liquid crystal display device of claim 1, wherein said drive circuits are constituted of polysilicon thin-film transistors and incorporated in the active matrix substrate.

8. A driving method of an active matrix liquid crystal display device including a liquid crystal cell disposed at each intersection of the matrix and at least one thin-film transistor connected to the liquid crystal cell, said method comprising the steps of:

storing an image data for a pixel in a frame memory;

inputting said stored image data and a next image data for said pixel into a movement detecting circuit;

detecting whether said pixel has a movement component based on difference data obtained by subtracting said stored image data from said next image data in said movement detecting circuit;

generating a pulse signal in a signal generating circuit;

supplying a first signal having a first waveform into said transistor in said pixel when said pixel has a movement component;

supplying a second signal having a second waveform different from the first waveform into said transistor in said pixel when said pixel has no movement component, wherein said first signal is obtained by adding said pulse signal to the image data stored in said frame memory.

9. A driving method of claim 8 wherein the application of said second voltage comprises the following steps;

applying a high voltage during a first period;

applying a low voltage during a second period after the first period;

wherein said first period is shorter than said second period, and said first and second periods are within one frame.

10. A driving method of claim 8 wherein the application of said second voltage comprises the following steps;

sequentially applying a high voltage and a low voltage in a frame sequentially applying a low voltage and a high voltage in a frame after one or more frame periods thereof.

11. The method of claim 8 wherein said second waveform has a first voltage higher than a voltage of said first waveform, and has a second voltage subsequent to said first voltage and lower than said first voltage.

12. An active matrix liquid crystal display device including a liquid crystal cell disposed at each intersection of the matrix, and means for detecting whether a pixel has a movement component based on an image signal for said pixel, said device comprising:

a frame memory for storing said image signal;

a movement detecting circuit for detecting whether said image signal includes movement components, based upon said image signal and said stored image signal;

a signal generating circuit for generating a pulse signal; and an adder connected to said frame memory, said movement detecting circuit and said signal generating circuit.

* * * * *